US006940027B1

(12) United States Patent
Sipe

(10) Patent No.: US 6,940,027 B1
(45) Date of Patent: Sep. 6, 2005

(54) OPERATING HANDLE LOCKING ASSEMBLY FOR AN ELECTRICAL SWITCHING APPARATUS

(75) Inventor: Warren C. Sipe, Cleveland, TN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/862,796

(22) Filed: Jun. 7, 2004

(51) Int. Cl.[7] ..... H01H 9/28
(52) U.S. Cl. ..... 200/43.14; 200/43.19
(58) Field of Search ..... 200/43.11–43.16, 200/43.19, 43.22, 334

(56) References Cited

U.S. PATENT DOCUMENTS

| | | | | |
|---|---|---|---|---|
| 2,695,934 A | * | 11/1954 | Willis | 200/50.19 |
| 2,849,552 A | | 8/1958 | Firestone | |
| 3,076,876 A | * | 2/1963 | Stanback et al. | 200/43.15 |
| 3,214,530 A | | 10/1965 | Tharp et al. | |
| 3,255,320 A | * | 6/1966 | Norden | 200/43.15 |
| 3,408,466 A | | 10/1968 | Palmer | |
| 4,347,412 A | | 8/1982 | Mihara et al. | |
| 4,912,599 A | | 3/1990 | Wittmer | |
| 5,147,991 A | | 9/1992 | Jordan, Sr. | |
| 5,219,070 A | | 6/1993 | Grunert et al. | |
| 5,310,969 A | | 5/1994 | Turek et al. | |
| 5,341,191 A | | 8/1994 | Crookston et al. | |
| 5,412,167 A | | 5/1995 | Mueller et al. | |
| 5,500,495 A | | 3/1996 | Benda et al. | |
| 5,577,599 A | | 11/1996 | Turek et al. | |
| 5,732,815 A | | 3/1998 | Brouwer | |
| 5,775,481 A | | 7/1998 | Lyke | |
| 5,817,998 A | | 10/1998 | Siebels et al. | |
| 5,817,999 A | | 10/1998 | Mugan et al. | |
| 6,160,227 A | | 12/2000 | Singer | |
| 6,791,040 B1 | * | 9/2004 | Puhalla et al. | 200/43.14 |

OTHER PUBLICATIONS

U.S. Appl. No. 10/662,655, filed Sep. 15, 2003, Puhalla et al.

* cited by examiner

*Primary Examiner*—Elvin G. Enad
*Assistant Examiner*—Lisa Klaus
(74) *Attorney, Agent, or Firm*—Martin J Moran

(57) ABSTRACT

A locking assembly is for a circuit breaker including an enclosure and an operating handle operable between a first, ON position and a second, OFF position with respect to the enclosure. The operating handle includes a first aperture extending therethrough. The locking assembly includes a stationary element coupled to the enclosure and includes a second aperture extending therethrough. The second aperture corresponds with the first aperture of the operating handle when aligned therewith. A blocking element coupled to the operating handle blocks the second aperture when the operating handle is disposed in any position other than the second, OFF position in which the first aperture extending through the operating handle is aligned with the second aperture of the stationary element. A lock is inserted through the aligned apertures in order to lock the operating handle in the second, OFF position.

19 Claims, 5 Drawing Sheets

OPERATING HANDLE LOCKING ASSEMBLY FOR AN ELECTRICAL SWITCHING APPARATUS

BACKGROUND OF THE INVENTION

1. Field of the Invention

The present invention relates generally to electrical switching apparatus and, more particularly, to a locking assembly for the operating handle of a circuit breaker.

2. Background Information

Electrical switching apparatus include, for example, circuit switching devices and circuit interrupters such as circuit breakers, contactors, motor starters, motor controllers and other load controllers.

Circuit breakers are generally old and well known in the art. An example of a circuit breaker is disclosed in U.S. Pat. No. 5,341,191. Circuit breakers are used to protect electrical circuitry and equipment from damage due to an over current condition, such as an overload condition or a relatively high level short circuit or fault condition. Molded case circuit breakers, for example, include at least one pair of separable contacts which are operated either manually by way of a handle disposed on the outside of the case or automatically by way of an internal trip unit in response to an over current condition.

Circuit breakers typically have two or three possible operating handle positions, corresponding to the status of the separable contacts. For example, these positions may include an ON position, in which the separable contacts are closed, an OFF position in which the contacts are open, and a tripped position in which the contacts are tripped open. Typically, the handle position corresponding to the tripped position of the contacts is in between the ON and OFF positions.

In circuit breaker installations, for example in a panel board or load center, it is often desirable or essential that the settings of a single circuit breaker, or a group of circuit breakers, remain undisturbed. Unauthorized or inadvertent changing of the position of these breakers could result in annoying interruptions to service or operations, serious damage to an electrical apparatus, or even serious harm to a person. For example, accidental actuation of a circuit breaker might result in electrocution or shock to a workman performing electrical work or repair on equipment downstream from the circuit breaker. Therefore, to prevent, for example, another person from inadvertently returning the circuit breaker handle to the ON position when a worker is doing electrical work in an area other than the immediate vicinity of the circuit breaker box or electrical panel, safety measures must be taken. One such safety measure is the addition of a locking assembly to prevent displacement of the circuit breaker operating handle.

U.S. Pat. Nos. 2,849,552; 3,214,530; 3,408,466; 4,347,412; 5,147,991; 5,219,070; 5,310,969; 5,412,167; 5,500,495; 5,577,599; 5,732,815; 5,817,998; and 5,817,999 disclose handle locking mechanisms consisting of an assembly of at least two parts and each employs a padlock to lock the handle of the circuit breaker in a fixed position. There are several disadvantages associated with known handle locking mechanisms of this type.

One problematic attribute of such locking provisions is the possibility of creating an unintentional lock-ON condition. For example, many known locking assemblies of this type permit the padlock to engage the assembly (i.e., inserting the hasp of the padlock through a receiving opening in one or more locking assembly components) when the circuit breaker handle is in the ON position. The engaged lock can prevent the circuit breaker handle or other operating mechanism from achieving sufficient rotation or movement to open the circuit. Moreover, although known locking assemblies of this type are generally only intended to lock the handle in the OFF position, most can just as easily lock the handle in the ON position by inadvertently reversing the direction in which the assembly is attached to the handle. Accidentally locking the handle in the ON position creates an unsafe condition by hampering emergency shut-off of the equipment.

There are a number of known variations of these types of locking mechanisms. For example, many such locking mechanisms employ a set or Allen screw to engage the circuit breaker handle, in order to prohibit its movement. See, e.g., U.S. Pat. Nos. 2,849,552; 5,147,991; 5,500,495; and 5,732,815. Construction of the locking mechanisms is typically complex and often comprises numerous, separate parts. Generally, the locking mechanisms are not integrated with the circuit breaker, thereby being susceptible to loss of one or more pieces when not in use. Applicability is often limited to a certain type of circuit breaker or a select type or shape of circuit breaker handle. See, e.g., U.S. Pat. Nos. 3,408,466; 4,347,412; 5,219,070; 5,412,167; and 5,817,999. Many known locking mechanisms of this type also employ at least one nose, wedge, end part, leg or similar structure adapted for insertion within the handle opening of the circuit breaker housing, for example, between the circuit breaker handle and the end wall of the handle opening, to abut, underlie or otherwise engage the end wall, in order to resist movement of the circuit breaker handle. See, e.g., U.S. Pat. Nos. 2,849,552; 3,408,466; 4,347,412; 5,412,167; 5,500,495; 5,732,815; and 5,817,998.

As shown in FIG. 1, another known locking assembly 2 attempts to overcome the aforementioned disadvantage by employing a slider plate assembly 4 attached to the circuit breaker operating handle 6 and a separate fixed shroud 8 overlying the operating handle 6 and slider plate assembly 4. The slider plate assembly 4 includes an elongated laterally extending portion 10 and a tab projection 12, which projects perpendicularly from the operating handle 6. The fixed shroud 8 includes an elongated lock-OFF opening 14 for receiving the hasp 16 of the padlock 18 and a slot 20 for receiving the tab projection 12 of the slider plate assembly 4 when the circuit breaker operating handle 6 is in the OFF position, as shown. The circuit breaker operating handle 6 includes an elongated, laterally extending portion 22 with a lock-OFF opening 24. This elongated laterally extending portion 22 corresponds to the laterally extending portion 10 of the slider plate assembly 4. Unless the operating handle 6 is in the OFF position (as shown) and the slider plate 4 is pushed upward (as shown in phantom line drawing in FIG. 1), against the force of gravity until the tab projection 12 is received in the slot 20 on the fixed shroud 8 (see, e.g., tab projection 12 of slider plate assembly 4 shown in phantom line drawing in FIG. 1), the elongated laterally extending portion 10 of the slider plate assembly 4 blocks the lock-OFF openings 14, 24 of both the fixed shroud 8 and the operating handle 6. Then, in order to lock the handle 6 in the OFF position, as shown, the slider plate 4 must be held in the upward position (see, e.g., tab projection 12 shown in phantom line drawing disposed in the upward position within slot 20 in FIG. 1) while the hasp 16 of the padlock 18 is inserted through the corresponding lock-OFF openings 14, 24. This locking assembly 2 continues to require numerous complex moving parts and the manual manipulation of at least the slider plate assembly 4, in order to permit the operating handle 6 to be locked in the OFF position.

Accordingly, there is room for improvement in electrical switching apparatus and operating handle locking assemblies for electrical switching apparatus.

SUMMARY OF THE INVENTION

There is a need, therefore, for a simplified locking assembly for electrical switching apparatus that provides a passive approach for restraining movement of the electrical switching apparatus handle from the OFF position and eliminates the possibility of inadvertently locking the handle in the ON position or any other position in which the electrical switching apparatus continues to supply power.

These needs and others are satisfied by the present invention, which is directed to an operating handle locking assembly for an electrical switching apparatus. The locking assembly is operable (e.g., permits the insertion of a locking member, such as the hasp of a padlock) to restrain movement of the operating handle only when the operating handle is in the OFF position and, apart from insertion of the hasp, requires no manual manipulation (e.g., without limitation, positioning the locking assembly with respect to the handle; positioning of individual assembly components). The locking assembly can, therefore, be employed to restrain movement of the operating handle from the OFF position, as desired, while preventing the possibility of inadvertently locking the operating handle in the ON position or any other undesirable position. The locking assembly may employ a wide variety of user supplied locks to restrain movement of the operating handle from the OFF position.

As one aspect of the invention, a locking assembly is for an electrical switching apparatus including an enclosure and an operating handle operable between a first position and a second position with respect to the enclosure. The operating handle includes a first aperture extending therethrough. The locking assembly comprises: a stationary element coupled to the enclosure and includes a second aperture extending therethrough, the second aperture corresponding with the first aperture of the operating handle when aligned therewith; a blocking element coupled to the operating handle and structured to block the second aperture of the stationary element when the operating handle is disposed in any position other than the second position in which the first aperture extending through the operating handle is aligned with the second aperture extending through the stationary element; and a lock structured for insertion through the aligned first and second apertures in order to lock the operating handle in the second position.

The blocking element may be a plate element fastened to the operating handle and structured to move with the operating handle, but not independently with respect thereto.

As another aspect of the invention, a locking assembly is for an electrical switching apparatus housed in an enclosure and including an operating handle with an elongated shaft and a first aperture extending therethrough, the operating handle protruding from the enclosure and moving between first and second positions in relation thereto. The locking assembly comprises: a lock having a hasp; a stationary element coupled to the enclosure and at least partially covering the elongated shaft of the operating handle protruding therefrom, the stationary element including a second aperture extending therethrough; and a blocking element coupled to the elongated shaft of the operating handle, the blocking element blocking the second aperture extending through the stationary element when the operating handle is disposed in any position other than the second position in which the first aperture extending through the elongated shaft of the operating handle aligns with the second aperture of the stationary element, in order to receive the hasp of the lock through the aligned first and second apertures, thereby restraining movement of the operating handle.

The lock may have a locked position wherein the lock is disposed in the locked position when the operating handle is disposed in the aforementioned second position. The hasp of the lock may be received through the aligned first and second apertures of the elongated shaft of the operating handle and of the stationary element, respectively, in order to prevent operation of the operating handle from the second position.

As another aspect of the invention, an electrical switching apparatus comprises: an enclosure; separable contacts; an operating mechanism including an operating handle having an elongated shaft and a first aperture extending herethrough, the operating handle protruding from the enclosure and moving between first and second positions in relation to the enclosure, in order to close and open, respectively, the separable contacts; and a locking assembly comprising: a lock having a hasp; a stationary element coupled to the enclosure and at least partially covering the elongated shaft of the operating handle, the stationary element including a second aperture extending therethrough; and a blocking element fixedly coupled to the elongated shaft of the operating handle, the blocking element blocking the second aperture extending through the stationary element when the operating handle is disposed in any position other than the second position in which the first aperture extending through the elongated shaft of the operating handle aligns with the second aperture in the stationary element, in order to receive the hasp of the lock through the aligned first and second apertures, thereby restraining movement of the operating handle.

The operating handle may have a radial axis wherein the first aperture extending through the elongated shaft of the operating handle is disposed along the radial axis.

The electrical switching may be a circuit breaker wherein the separable contacts are closed and opened by moving the operating handle between the first and second positions, respectively, wherein the first position corresponds to the separable contacts being closed, wherein the second position corresponds to the separable contacts being open and wherein the hasp of the lock only locks the circuit breaker when the separable contacts are open. The circuit breaker may be an enclosed circuit breaker wherein the enclosure of the enclosed circuit breaker includes a first side and a second side and wherein the operating handle and the stationary element are coupled to one of the first and second sides of the enclosure, in order that the stationary element overlaps a portion of the elongated shaft of the operating handle while permitting the handle to rotate therein.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the invention will be described as applied to an enclosed circuit breaker, although it will become apparent that it could also be applied to other types of circuit breakers (e.g., without limitation, molded case circuit breakers; single pole circuit breakers; multi-pole circuit breakers) and other types of electrical switching apparatus (e.g., without limitation, circuit switching devices and other circuit interrupters such as contactors, motor starters, motor controllers and other load controllers).

As employed herein, the term "fastener" refers to any suitable fastening, connecting or tightening mechanism expressly including, but not limited to, rivets, screws, bolts, the combination of bolts and nuts, and derivatives thereof.

As employed herein, the statement that two or more parts are "coupled" together shall mean that the parts are joined together either directly or joined through one or more intermediate parts.

Figure 2:
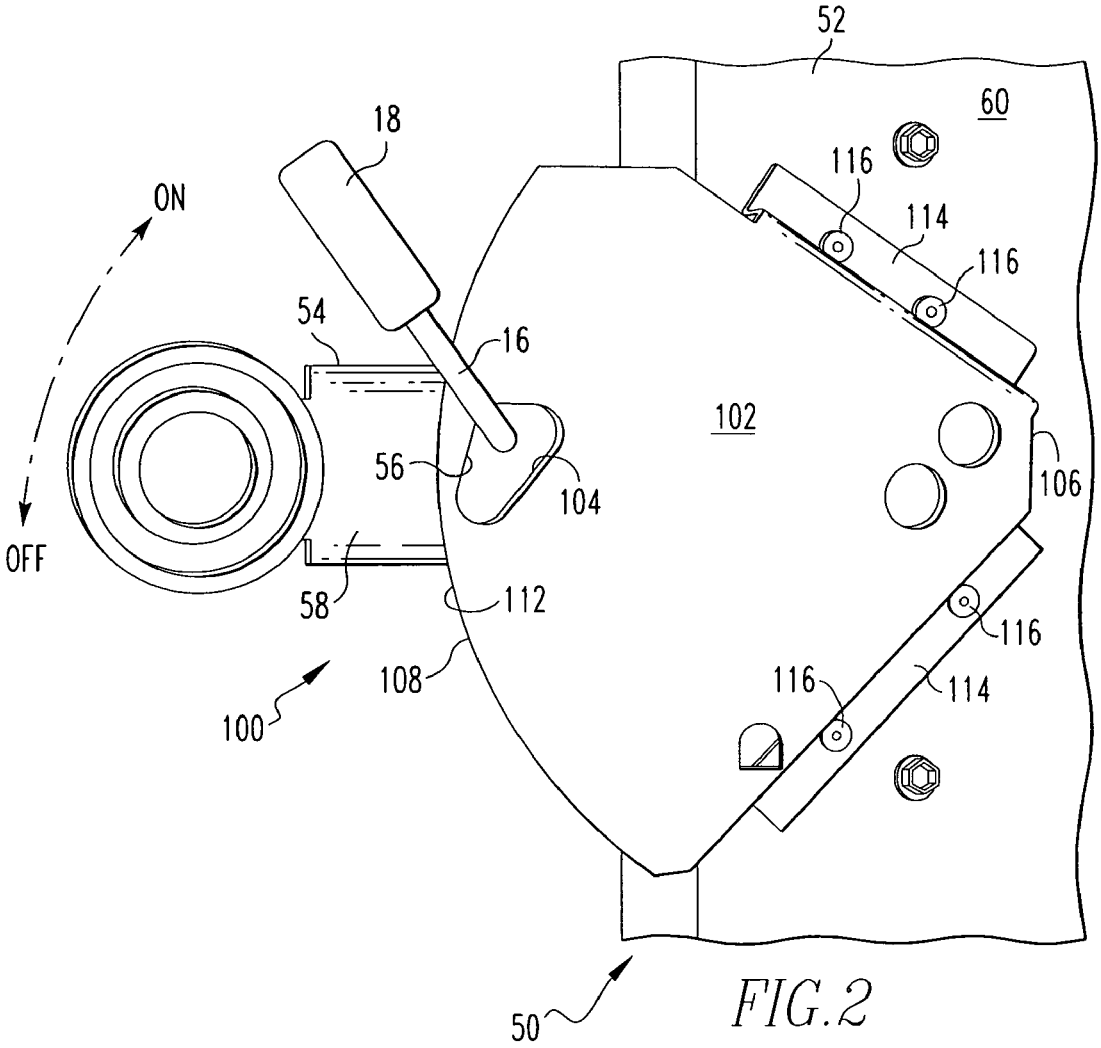
FIG. 2 is a vertical elevational view of the first side of a locking assembly in accordance with the present invention and an associated enclosed circuit breaker, with a padlock employed to lock the operating handle of the circuit breaker in the OFF position.
Figure 3:
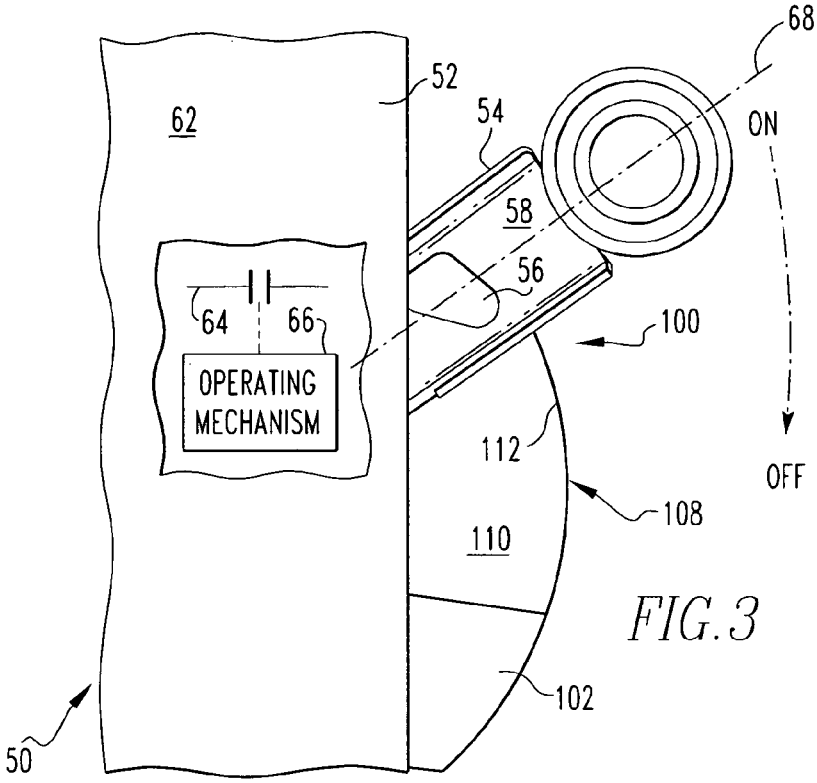
FIG. 3 is a vertical elevational view of the second side of the locking assembly and associated enclosed circuit breaker of FIG. 2, with the circuit breaker operating handle disposed in the ON position, the padlock removed and a portion of the enclosure cut-away to show internal structures.

FIGS. 2 and 3 show a handle locking assembly 100 generally including a stationary element 102, a blocking element 112 and a lock 18. The locking assembly 100 is structured for use with electrical switching apparatus such as the exemplary enclosed circuit breaker 50, shown.

As shown in FIGS. 2 and 3, the exemplary enclosed circuit breaker 50 generally includes an enclosure 52 and an operating handle 54 extending outwardly from the enclosure 52. As will be discussed herein, the operating handle 54 is operable between a first position and a second position with respect to the enclosure 52. The exemplary enclosure 52 includes a first side 60 (FIG. 2) and a second side 62 (FIG. 3). The exemplary operating handle 54 is coupled to the first side 60 of the enclosure 52 as shown in FIG. 2.

As shown in FIG. 3, the enclosure 52 houses separable contacts 64 and an operating mechanism 66. The operating handle 54, as part of the operating mechanism 66, closes and opens the separable contacts 64 when it is moved (i.e., pivoted) between the first and second positions, respectively, with respect to the enclosure 52. The first position corresponds to an ON circuit breaker condition in which the separable contacts 64 are closed, thereby providing electrical power to electrical equipment (not shown) downstream of the breaker 50. The second position corresponds to an OFF circuit breaker condition in which the separable contacts 64 are open and therefore not supplying power to the downstream electrical equipment (not shown). The exemplary enclosed circuit breaker 50 includes one pair of separable contacts 64 and one operating mechanism 66 including the exemplary operating handle 54. However, it will be appreciated that the circuit breaker could employ more than one pair of separable contacts (not shown) which could be controlled by one or more operating mechanisms (not shown) each having an operating handle (not shown). Circuit breakers having more than one operating handle (not shown) (e.g., ganged operating handles) are commonly referred to as multi-pole circuit breakers. It will be appreciated that the locking assembly 100 of the present invention can be employed with such multi-pole circuit breakers (not shown).

Figure 1:
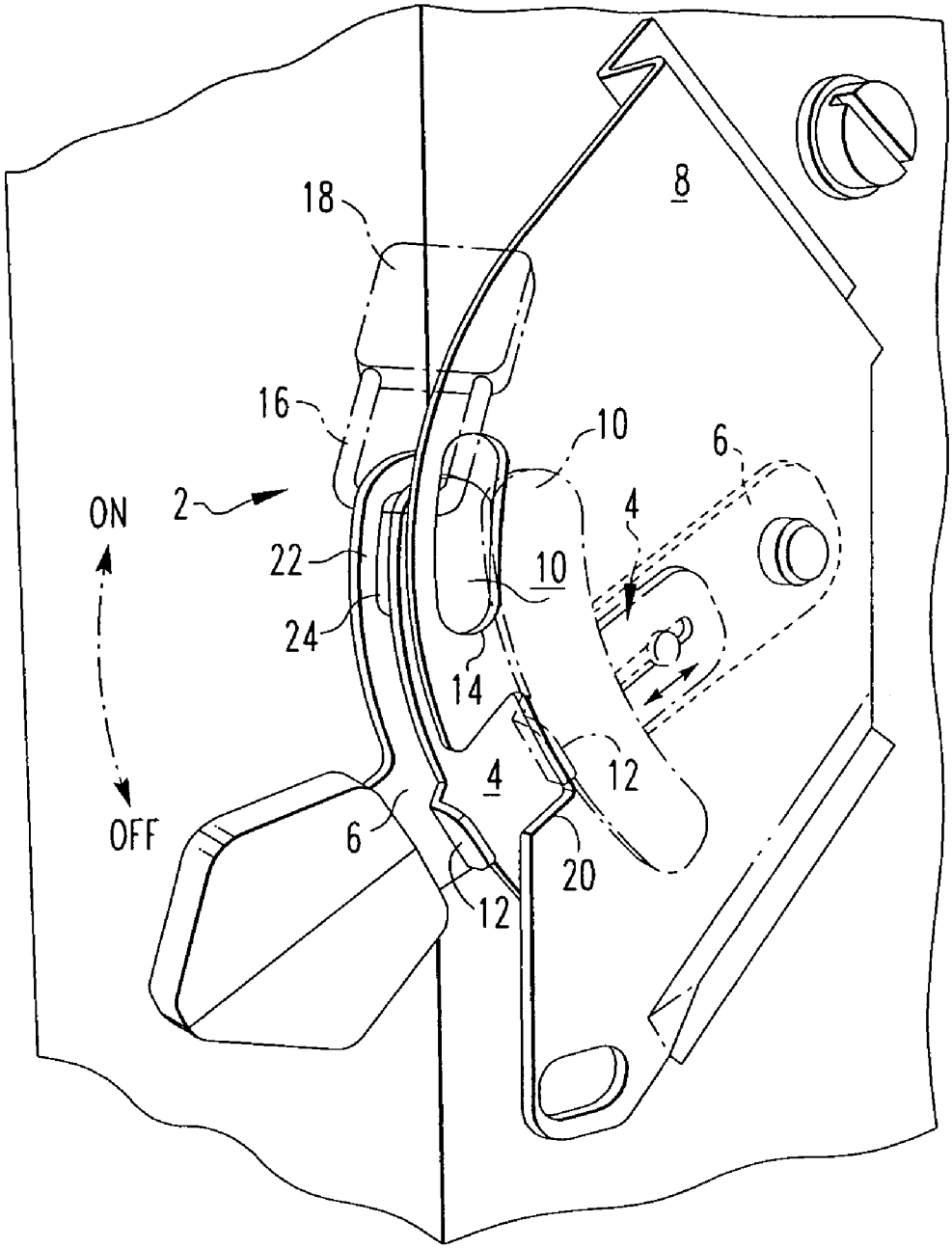
FIG. 1 PRIOR ART
FIG. 1 is an isometric view of the first side of a locking assembly including a slider plate assembly and an associated enclosed circuit breaker, with a padlock shown in phantom line drawing being employed to lock the operating handle of the circuit breaker in the OFF position.

Referring again to FIG. 2, the circuit breaker operating handle 54 includes a first aperture 56 extending therethrough. As shown, the exemplary operating handle 54 includes an elongated, generally rectangular-shaped shaft 58 having a radial axis 68 (FIG. 3) with the exemplary first aperture 56 being disposed along such axis 68. The stationary element 102 of the exemplary locking assembly 100 is coupled to the first side 60 of the enclosure 52, and is structured to overlap a portion of the elongated, generally rectangular-shaped operating handle shaft 58 while permitting the shaft 58 to pivot between the OFF (FIG. 1) and ON (FIG. 2) positions. As shown, the exemplary stationary element 102 is generally pie-shaped, in order to accommodate such pivoting. The exemplary generally pie-shaped stationary element 102 has a first end 106 and a larger second end 108 having an accurate shape. The stationary element 102 includes two flanges 114 structured to receive fasteners, such as the exemplary rivets 116 (FIG. 2), for coupling the stationary element 102 to first side 60 of the circuit breaker enclosure 52. However, it will be appreciated that any suitable alternative attachment mechanism (not shown) and configuration (not shown) other than the exemplary flanges 114 and rivet fasteners 116, could be employed to couple the stationary element 102 to the enclosure 52.

The stationary element 102 includes a second aperture 104 proximate the exemplary arcuate portion of the larger second end 108 thereof. The second aperture 104 corresponds with the first aperture 56 of the operating handle 54 when aligned therewith. For example, as shown in FIG. 2, the first aperture 56 extending through the elongated shaft 58 of the circuit breaker operating handle 54 aligns with the second aperture 104 extending through the stationary element 102 only when the operating handle 54 is disposed in the OFF position, wherein the separable contacts 64 (FIG. 3) are open. Accordingly, the lock 18 may only be employed to lock the operating handle 54 when it is in the OFF position.

The exemplary lock is a padlock 18 including a hasp 16 which is inserted through the aligned first and second apertures 56, 104, respectively. However, it will be appreciated that any suitable locking element (e.g., without limitation, a dowel, a pin, a wire or any other suitable insert) (not shown) other than the exemplary lock hasp 16 could be inserted through aligned apertures (e.g., 56, 104) in stationary element 102 and operating handle 54, in order to restrain movement of the circuit breaker operating handle 54. As another possible alternative, for example, without limitation, wire (not shown) could be inserted through aligned apertures (e.g., 56, 104) and sealed (not shown). The sealed wire locking mechanism (not shown) would prevent unauthorized manipulation of the circuit breaker operating handle 54 without first cutting the wire (not shown). It will be appreciated that these and other suitable locking mechanisms (not shown), in addition to the exemplary lock 18 and hasp 16, could be employed to lock a locking assembly (e.g., 100), thereby restraining movement of an operating handle (e.g., 54) from the OFF position.

Figure 4:
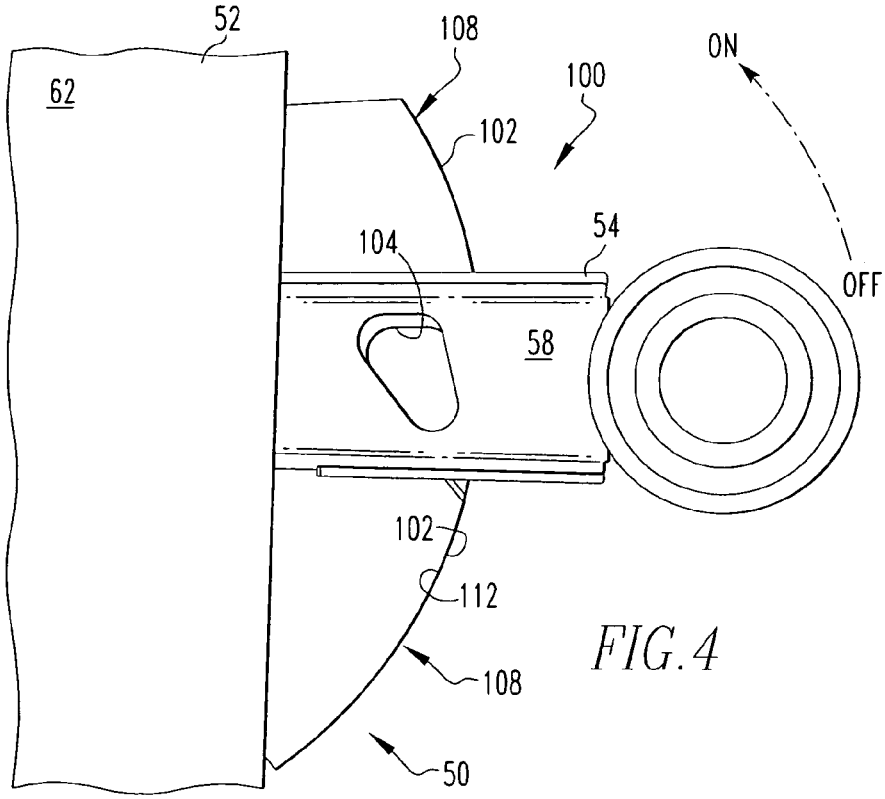
FIG. 4 is a vertical elevational view of the locking assembly and associated enclosed circuit breaker of FIG. 3 with the operating handle disposed in the OFF position.
Figure 5:
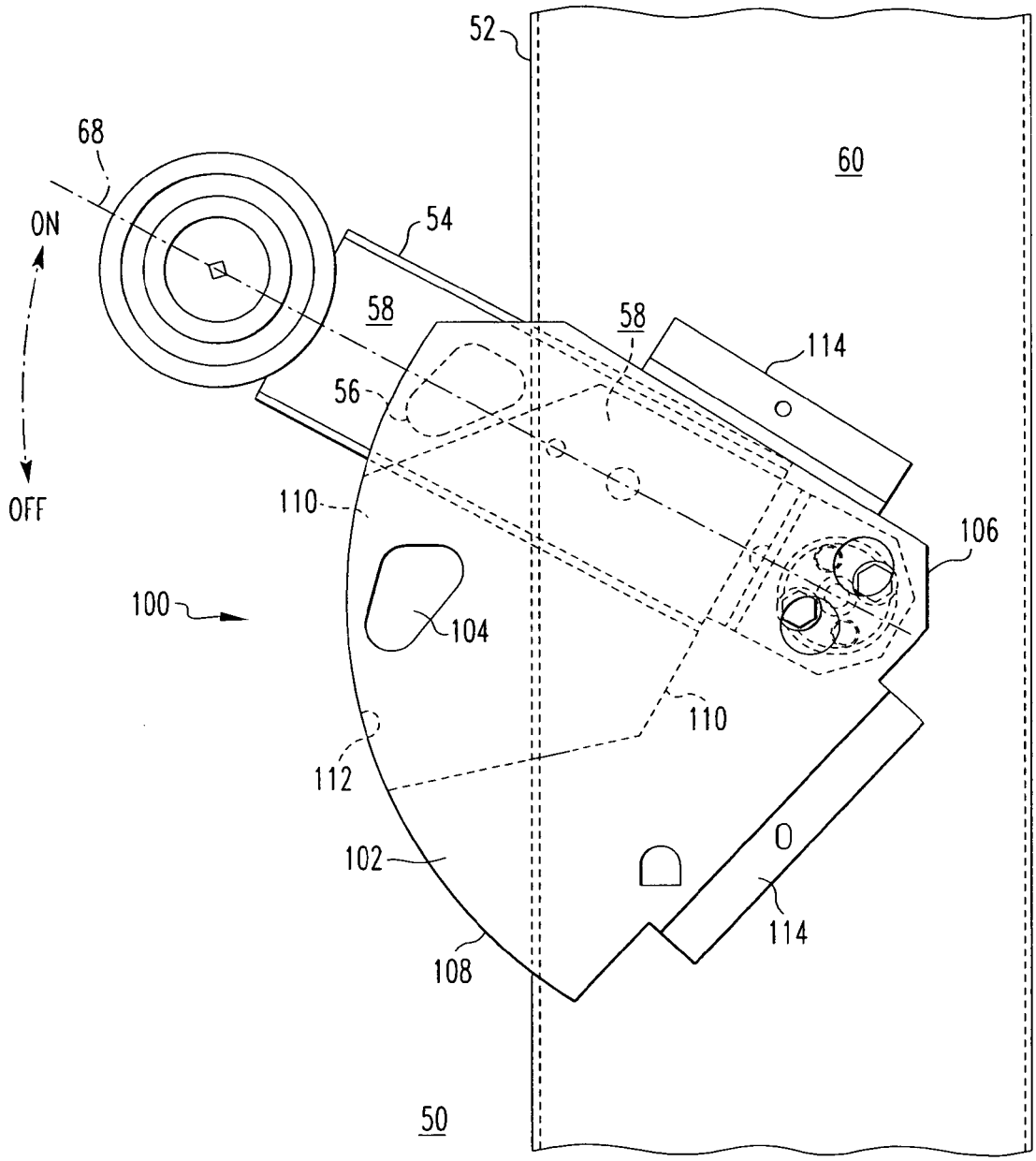
FIG. 5 is a vertical elevational view of the locking assembly and associated enclosed circuit breaker of FIG. 2 showing internal locking assembly structures in hidden line drawing as positioned when the circuit breaker operating handle is disposed in the ON position.
Figure 6:
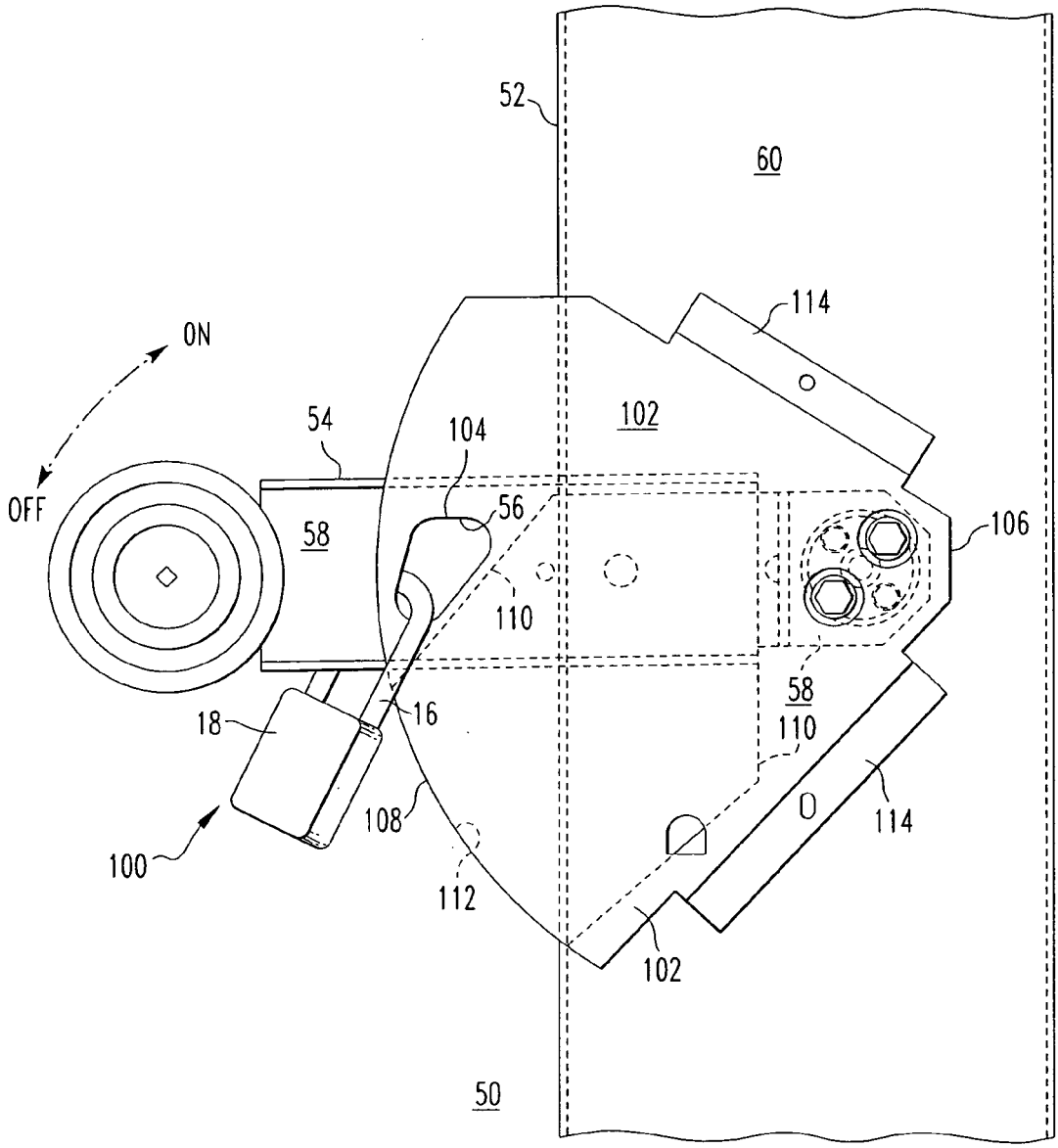
FIG. 6 is a vertical elevational view of the locking assembly and associated enclosed circuit breaker of FIG. 4 showing internal locking assembly structures in hidden line drawing, as positioned when the circuit breaker operating handle is in the OFF position and a padlock is employed to restrain movement of the operating handle from the OFF position.

As best shown in FIGS. 3, 5 and 6, the exemplary locking assembly blocking element is a plate element 110 fastened to the elongated shaft 58 of the operating handle 54 adjacent the first aperture 56 extending therethrough. Therefore, as previously discussed, the exemplary plate element 102 moves with the operating handle 54, but not independently with respect thereto, in order to block the second aperture 104 in the stationary element 102 when the operating handle 54 is disposed in any position other than the OFF position (see, e.g., blocked first aperture 56 in FIGS. 3 and 5 compared to aligned first and second apertures 56, 104 in FIGS. 4 and 6). In this manner, the exemplary locking assembly 100 eliminates the possibility of inadvertently locking the operating handle 54 in, for example, the ON position. As previously discussed, inadvertently locking the operating handle 54 in a position in which the separable contacts 64 are closed (i.e., in the ON position) hampers emergency shutoff of electrical equipment and results in an unsafe condition. The hasp 16 of the exemplary padlock 18 (FIGS. 2 and 6) only locks the circuit breaker 50 when the separable contacts 64 are open, thereby eliminating the possibility of such an undesirable occurrence.

As shown in FIGS. 3, 5 and 6, the exemplary plate element 110 further includes an arcuate portion 112 corresponding to the arcuate shape of the larger second end 108 of the exemplary generally pie-shaped stationary element 102. However, it will be appreciated that any suitable alternative blocking element shape (not shown) or configuration (not shown) could be employed other than the blocking element 110 shown in the figures and described herein.

FIGS. 3 and 4 illustrate the exemplary locking assembly 100 as shown from the second side 62 of the circuit breaker enclosure 52. FIG. 3 shows the operating handle 54 in the ON position in which both the first and second apertures 56, 104 are blocked, whereas FIG. 4 shows the operating handle 54 disposed in the OFF position in which the first and second apertures 56, 104 are aligned, thereby permitting the insertion of the locking mechanism (see, e.g., hasp 16 of padlock 18, FIGS. 2 and 6).

FIGS. 5 and 6 illustrate the exemplary locking assembly 100 as shown from the first side 60 of the circuit breaker enclosure 52, with the circuit breaker operating handle 54 in the ON (FIG. 5) and OFF (FIG. 6) positions. FIGS. 5 and 6 further illustrate internal locking assembly structures in hidden line drawing. For example, the relative positions of the exemplary plate element 110, the exemplary elongated, generally rectangular-shaped shaft 58 of the operating handle 54 and the first aperture 56 extending therethrough, are shown. As previously discussed, the first aperture 56 extends through the exemplary elongated, generally rectangular-shaped shaft 58 of the operating handle 54 adjacent the plate element 110 fastened thereto. More specifically, as shown in FIG. 5, the first aperture 56 is disposed on the radial axis 68 of the shaft 58 at a location which permits it to align with the second aperture 104 extending through the stationary element 102 only when the operating handle 54 is disposed in the second, OFF position (FIG. 6). Accordingly, when the operating handle 54 is disposed in the ON position or any other position other than the OFF position, the first aperture 56 is blocked by the stationary element 102 of the locking assembly 100 and is therefore inaccessible (i.e., incapable of being inadvertently locked). Additionally, the second aperture 104 is blocked by the exemplary plate element 110 (see, for example, FIG. 5). Therefore, it is believed that the locking assembly 100 of the present invention provides a redundant and thus safer design, when compared with the known prior art.

A further comparison of FIG. 5, in which the circuit breaker operating handle 54 is in the ON position, with FIG. 6, in which the circuit breaker operating handle 54 is in the OFF position, helps to illustrate the aforementioned manner in which the exemplary plate element 110 rotates with the operating handle 54, but not independently with respect thereto. Specifically, as previously discussed, the exemplary plate element 110 includes the arcuate portion 112 corresponding with the second, larger end 108 of the exemplary pie-shaped stationary element 102. The arcuate portion 112 maintains this corresponding relationship with the second, larger end 108 throughout its rotation with respect thereto. This configuration and the fact that the exemplary first aperture 56 is disposed on the radial axis 68 (FIG. 5) of the operating handle 54 and adjacent the exemplary plate element 110 rather than, for example, through a portion of the plate element 110, enables the exemplary locking assembly 100 to operate by merely inserting a locking mechanism (e.g., 16) through the aligned first and second apertures 56, 104 respectively, when the operating handle 54 is rotated to the OFF position. This is an entirely passive approach not requiring the manipulation of multiple complex components (see, e.g., slider plate assembly 4 in FIG. 1), in order to lock the operating handle 54, when it is disposed in the desired position.

Accordingly, the relatively simplistic, safe and tamper-resistant locking assembly 100 of the present invention provides a valuable safety feature and added security measure for electrical switching applications where maintaining the switch handle position status is critical. The invention offers a safer and simplified locking assembly 100 over the known prior art by eliminating unnecessary, cumbersome parts, complex designs and numerous steps to employ. The exemplary locking assembly 100 is also an integral part of the circuit breaker (e.g., 50), permitting free operation of the operating handle (e.g., 54) when not employed while eliminating the possibility of inadvertently losing one or more lock assembly parts. Additionally, as discussed above, the locking assembly 100 may be used with a wide variety of locks (e.g., 18) having a wide variety of hasps (e.g., 16) or other suitable locking mechanisms (not shown).

It will be appreciated that the components of the locking assembly 100 may be made from a wide array of materials, including, without limitation, metal, such as aluminum or sheet steel, or thermoplastic material. The locking assembly 100 components may also be made using a wide variety of manufacturing processes, including, without limitation, rolling, forming or stamping.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A locking assembly for an electrical switching apparatus including an enclosure and an operating handle operable between a first position and a second position with respect to said enclosure, said operating handle including a first aperture extending therethrough, said locking assembly comprising:

a stationary element coupled to said enclosure and including a second aperture extending therethrough, the second aperture corresponding with the first aperture of said operating handle when aligned therewith;

a blocking element coupled to said operating handle and structured to block the second aperture of said stationary element when said operating handle is disposed in any position other than said second position in which the first aperture extending through said operating handle is aligned with the second aperture extending through said stationary element; and a lock structured for insertion through said aligned first and second apertures in order to lock said operating handle in said second position.

2. The locking assembly of claim 1 wherein said blocking element is a plate element fastened to said operating handle, said plate element being structured to move with said operating handle, but not independently with respect thereto.

3. A locking assembly for an electrical switching apparatus housed in an enclosure and including an operating handle with an elongated shaft and a first aperture extending therethrough, said operating handle protruding from said enclosure and moving between first and second positions in relation thereto, said locking assembly comprising:

a lock having a hasp;

a stationary element coupled to said enclosure and at least partially covering the elongated shaft of said operating handle protruding therefrom, said stationary element including a second aperture extending therethrough; and a blocking element coupled to the elongated shaft of said operating handle, said blocking element blocking the second aperture extending through said stationary element when said operating handle is disposed in any position other than said second position in which the first aperture extending through the elongated shaft of said operating handle aligns with the second aperture of said stationary element, in order to receive the hasp of said lock through said aligned first and second apertures, thereby restraining movement of said operating handle.

4. The locking assembly of claim 3 wherein said lock has a locked position; and wherein said lock is disposed in said locked position when said operating handle is disposed in said second position thereby receiving the hasp of said lock through said aligned first and second apertures of said elongated shaft of said operating handle and said stationary element, respectively, in order to prevent operation of said operating handle from said second position.

5. The locking assembly of claim 3 wherein said blocking element is a plate element fastened to the elongated shaft of said operating handle; wherein said plate element moves with the elongated shaft in order to block the second aperture of said stationary element when said operating handle is in any position other than said second position; and wherein said plate element does not move independently in relation to said operating handle.

6. The locking assembly of claim 5 wherein the elongated shaft of said operating handle is generally rectangular-shaped; and wherein said stationary element coupled to said enclosure is generally pie-shaped, in order to cover a portion of the generally rectangular-shaped elongated shaft of said operating handle while accommodating movement of said handle between said first and second positions.

7. The locking assembly of claim 6 wherein said generally pie-shaped stationary element has a first end and a larger second end, the larger second end having an arcuate shape; and wherein said plate element includes an arcuate portion corresponding with the arcuate shape of the larger second end of said generally pie-shaped stationary element.

8. The locking assembly of claim 7 wherein said second aperture extends through said generally pie-shaped stationary element proximate the arcuate shape of the larger second end thereof; wherein the arcuate portion of said plate element blocks the second aperture when said operating handle is disposed in any position other than said second position; and wherein the first aperture extends through the generally rectangular-shaped elongated shaft of said operating handle adjacent said plate element at a location in which the first aperture aligns with the second aperture when said operating handle is disposed in said second position.

9. The locking assembly of claim 3 wherein said electrical switching apparatus is a circuit breaker including separable contacts which are closed and opened by moving said operating handle between said first and second positions, respectively; wherein said first position corresponds to said separable contacts being closed; wherein said second position corresponds to said separable contacts being open; and wherein the hasp of said lock only locks said circuit breaker when said separable contacts are open.

10. The locking assembly of claim 9 wherein said circuit breaker is an enclosed circuit breaker; wherein the enclosure of said enclosed circuit breaker includes a first side and a second side; and wherein said operating handle and said stationary element are coupled to one of the first and second sides of said enclosure, in order that said stationary element overlaps a portion of the elongated shaft of said operating handle while permitting said handle to pivot therein.

11. An electrical switching apparatus comprising:

an enclosure;

separable contacts;

an operating mechanism including an operating handle having an elongated shaft and a first aperture extending therethrough, said operating handle protruding from said enclosure and moving between first and second positions in relation to said enclosure, in order to close and open, respectively, said separable contacts; and a locking assembly comprising:

a lock having a hasp;

a stationary element coupled to said enclosure and at least partially covering the elongated shaft of said operating handle, said stationary element including a second aperture extending therethrough; and a blocking element fixedly coupled to the elongated shaft of said operating handle, said blocking element blocking the second aperture extending through said stationary element when said operating handle is disposed in any position other than said second position in which the first aperture extending through the elongated shaft of said operating handle aligns with the second aperture in said stationary element, in order to receive the hasp of said lock through said aligned first and second apertures, thereby restraining movement of said operating handle.

12. The electrical switching apparatus of claim 11 wherein said lock has a locked position and is disposed in said locked position when said operating handle is disposed in said second position thereby receiving the hasp of said lock through said aligned first and second apertures of the elongated shaft of said operating handle and said stationary element, respectively, in order to prevent operation of said operating handle from said second position.

13. The electrical switching apparatus of claim 11 wherein said blocking element is a plate element fastened to the elongated shaft of said operating handle; wherein said plate element moves with said elongated shaft in order to block the second aperture of said stationary element when said operating handle is in any position other than said second position; and wherein said plate element does not move independently in relation to said operating handle.

14. The electrical switching apparatus of claim 13 wherein the elongated shaft of said operating handle is generally rectangular-shaped; and wherein said stationary element coupled to said enclosure is generally pie-shaped in order to cover a portion of the generally rectangular-shaped elongated shaft of said operating handle while accommodating movement of said operating handle between said first and second positions.

15. The electrical switching apparatus of claim 14 wherein said generally pie-shaped stationary element has a first end and a larger second end, the larger second end having an arcuate shape; and wherein said plate element includes an arcuate portion corresponding with the arcuate shape of the larger second end of said generally pie-shaped stationary element.

16. The electrical switching apparatus of claim 15 wherein said second aperture extends through said generally pie-shaped stationary element proximate the arcuate shape of the larger second end thereof; wherein the arcuate portion of said plate element blocks the second aperture when said operating handle is disposed in any position other than said second position; and wherein the first aperture extends through the generally rectangular-shaped elongated shaft of said operating handle adjacent said plate element at a location in which the first aperture aligns with the second aperture when said operating handle is disposed in said second position.

17. The electrical switching apparatus of claim 11 wherein said electrical switching apparatus is a circuit breaker; wherein said separable contacts are closed and opened by moving said operating handle between said first and second positions, respectively; wherein said first position corresponds to said separable contacts being closed; wherein said second position corresponds to said separable contacts being open; and wherein the hasp of said lock only locks said circuit breaker when said separable contacts are open.

18. The electrical switching apparatus of claim 17 wherein said circuit breaker is an enclosed circuit breaker; wherein the enclosure of said enclosed circuit breaker includes a first side and a second side; and wherein said operating handle and said stationary element are coupled to one of the first and second sides of said enclosure, in order that said stationary element overlaps a portion of the elongated shaft of said operating handle while permitting said handle to pivot therein.

19. The electrical switching apparatus of claim 11 wherein said operating handle has a radial axis; and wherein the first aperture extending through the elongated shaft of said operating handle is disposed along said radial axis.

* * * * *